US008451135B2

(12) United States Patent
Carl, Jr.

(10) Patent No.: US 8,451,135 B2
(45) Date of Patent: May 28, 2013

(54) ANTI-MASKING SYSTEM AND METHOD FOR MOTION DETECTORS

(75) Inventor: Robert H Carl, Jr., Webster, NY (US)

(73) Assignee: Robert Bosch GmbH, Stuttgart (DE)

( * ) Notice: Subject to any disclaimer, the term of this patent is extended or adjusted under 35 U.S.C. 154(b) by 954 days.

(21) Appl. No.: 12/454,427

(22) Filed: Aug. 17, 2009

(65) Prior Publication Data

US 2009/0303069 A1 Dec. 10, 2009

Related U.S. Application Data

(60) Provisional application No. 61/130,471, filed on May 30, 2008.

(51) Int. Cl.
*G08B 21/00* (2006.01)

(52) U.S. Cl.
USPC ..... 340/686.1; 340/555; 340/567; 340/693.5; 340/541

(58) Field of Classification Search
USPC ..... 340/506, 511, 521, 522, 541, 545.3, 340/552, 555, 556, 565, 567, 686.1, 693.5; 250/221, 222.1, 341.8, 342, 353, DIG. 1
See application file for complete search history.

(56) References Cited

U.S. PATENT DOCUMENTS

| | | | | |
|---|---|---|---|---|
| 4,242,669 | A | 12/1980 | Crick | |
| 4,752,768 | A | 6/1988 | Steers et al. | |
| 5,243,326 | A | 9/1993 | Disabato | |
| 5,481,362 | A * | 1/1996 | Van Den Brink et al. | 356/401 |
| 5,499,016 | A | 3/1996 | Pantus | |
| 5,831,529 | A | 11/1998 | Pantus | |
| 5,942,976 | A | 8/1999 | Wieser et al. | |
| 6,191,688 | B1 | 2/2001 | Sprouse | |
| 6,262,661 | B1 | 7/2001 | Mahler et al. | |
| 6,351,234 | B1 | 2/2002 | Choy | |
| 6,377,174 | B1 | 4/2002 | Siegwart et al. | |
| 6,469,625 | B1 | 10/2002 | Tomooka | |
| 6,529,129 | B1 | 3/2003 | Tomooka | |
| 7,265,670 | B2 * | 9/2007 | Pantus et al. | 340/541 |
| 2005/0200473 | A1 * | 9/2005 | Noguchi et al. | 340/507 |
| 2008/0084292 | A1 | 4/2008 | DiPoala | |

FOREIGN PATENT DOCUMENTS

| | | | |
|---|---|---|---|
| EP | 0 817 148 | A1 | 1/1988 |
| EP | 0 507 025 | A2 | 10/1992 |
| GB | 2 411 468 | A | 8/2005 |
| JP | 02-287278 | | 11/1990 |
| WO | WO 2006/095122 | A1 | 9/2006 |

OTHER PUBLICATIONS

Search report and Examination Statement from corresponding European Application No. 09006944.4-2215 issued by the European Patent Office and dated Oct. 6, 2009.
VISONIC Ltd., "X-Masking Detectors", 1999 X-Masking C-1827-8 (Rev. Aug. 1999), 4 pp.

* cited by examiner

*Primary Examiner* — Anh V La
(74) *Attorney, Agent, or Firm* — Faegre Baker Daniels LLP

(57) ABSTRACT

An anti-masking system and method for a motion detector includes a plurality of anti-masking components such as a spreading lens, at least one reflector located outside a housing of the motion detector, and a retroreflector located on the housing proximate to a lens. The system and method uses the plurality of anti-masking components to determine whether the lens of the motion detector has been masked by an object.

19 Claims, 6 Drawing Sheets

ANTI-MASKING SYSTEM AND METHOD FOR MOTION DETECTORS

CROSS REFERENCE TO RELATED APPLICATION

This application claims the benefit of U.S. Provisional Patent Application Ser. No. 61/130,471, filed May 30, 2008, the disclosure of which is expressly incorporated by reference herein.

FIELD OF THE INVENTION

The present invention relates to security systems. More particularly, embodiments of the invention are directed to an anti-masking system and method that detects tampering with motion detection components of a security system.

BACKGROUND AND SUMMARY OF THE DISCLOSURE

Currently, in the field of security systems, motion detectors are often provided to detect intruders. Many motion detectors incorporate passive infrared (PIR) technology and/or microwave (MW) technology.

PIR technology has long been used in motion detectors. The PIR sensor detects the difference between the infrared energy emitted from an intruder and that emitted from the ambient environment. Many PIR detectors utilize Fresnel lenses or custom shaped mirrors to focus infrared energy on a pyrodetector. The output signal from the pyrodetector is then processed via analog hardware and/or digital signal processing. Lenses and mirrors are designed to provide various detection zones emanating radially from the sensor. As a target moves across the PIR detection zones, the sensing elements within the pyrodetector are alternately exposed to the target IF energy, resulting in an alternating voltage output from the PIR sensor. The amplitude and frequency of this voltage vary with a number of factors including target size, speed, and direction relative to the PIR zones, difference between ambient and target temperature, width and spacing between the detection zones, and frequency response of the pyrodetector.

Upon receiving the signals, the detector may perform processing by comparing the received signal to one or more voltage thresholds. These threshold crossings produce positive and negative pulses that can be counted and timed, with certain combinations of pulse height, duration, and frequency being considered PIR alarms.

MW technology often operates on the principle of phase shift or Doppler effect. Unlike PIR, MW technology is an active technology. The MW detector transmits MW energy, which reflects off objects and returns to the MW detector. Moving objects result in a received signal that is frequency shifted from the original transmitted signal. The detector receives this signal, and generates an alternating voltage difference frequency signal which is then processed via hardware or digital signal processing. Processing may include comparison of the MW signal to one or more thresholds with certain combinations of quantity, duration, or frequency of threshold crossings considered MW alarms.

Intruders may attempt to sabotage or tamper with the motion detection components through various techniques. For example, intruders may attempt to mask detectors by coating a lens with an opaque substance (such as paint, tape or other object) that acts as a barrier between a motion detection sensor and the corresponding monitored space. Alternatively, intruders may attempt to cover or block the entire motion detector with an object or otherwise tamper with the motion detection components. Accordingly, security systems having motion detection components are often equipped with an anti-masking system that detects tampering with the motion detection components.

Anti-masking systems are typically designed to detect when a person attempts to cover or mask a motion sensor so that it cannot detect motion. The anti-masking function is typically performed by emitting an IR signal from the motion detector and detecting a reflection from a blocking object. Typically, a portion of the IR energy is directed through the lens of the detector to determine if something such as tape, spray paint or other article has been used to block the lens.

Intruders have developed certain techniques to defeat anti-masking functions in motion detectors. An illustrated embodiment of the anti-masking system and method of the present disclosure uses a plurality of different anti-masking functions executed at different times to reduce the likelihood that an intruder may be able to defeat the anti-masking function.

In an illustrated embodiment of the present disclosure, an anti-masking system is provided for a motion detector including a housing having a lens. The anti-masking system comprises at least one energy source, a spreading lens configured to receive energy from an energy source and to emit the energy outside the housing of the motion detector, a spreading lens sensor located inside the housing to detect energy emitted from the spreading lens which is reflected back into the housing through the lens from an object located outside the housing, and at least one reflector located outside the housing adjacent the lens. The at least one reflector is configured to reflect energy received from an energy source back into the housing through the lens. The anti-masking system also comprises a reflector sensor located within the housing, the reflector sensor detecting reflected energy from the at least one reflector to determine whether an object is located between the at least one reflector and the lens, and a retroreflector located on the housing proximate to the lens. The retroreflector is configured to receive and reflect energy from an energy source. The anti-masking system further comprises a retroreflector sensor located within the housing to detect energy reflected back into the housing by the retroreflector to determine whether an object is located on the retroreflector, and a controller configured to selectively supply energy from the at least one energy source to the spreading lens, the at least one reflector, and the retroreflector. The controller is configured to monitor signals from the spreading lens sensor, the reflector sensor, and the retroreflector sensor to determine whether the lens of the motion detector has been masked by an object.

In one illustrated embodiment, the controller is configured to control a timing circuit sequentially to supply energy from the at least one energy source to the spreading lens, to detect a response from the spreading lens sensor to determine whether an object is reflecting energy back into the housing through the lens, to supply energy from the at least one energy source to the at least one reflector, to detect a response of the reflector sensor to determine whether an object is located between the at least one reflector and the lens, to supply energy from the at least one energy source to the retroreflector, to detect a response from the retroreflector sensor to determine whether an object is located on the retroreflector, to start an anti-mask alarm timer in response to any detecting such objects, and to issue an anti-mask alarm when the anti-mask timer exceeds a predetermined trigger time. Performing these operations sequentially at separate times may reduce the likelihood that an intruder may defeat the anti-masking system. In another illustrated embodiment, the controller may cause the steps to be performed simultaneously.

In another illustrated embodiment of the present disclosure, a method is provided for controlling operation of an anti-masking system of a motion detector having a lens and a housing. The method comprises providing energy to a spreading lens to emit energy to an area outside the housing, monitoring a spreading lens sensor to detect an object reflecting energy emitted from the spreading lens back into the housing through the lens, providing energy to a reflector located outside the housing adjacent the lens, the reflector reflecting the energy back into the housing through the lens, and monitoring a reflector sensor to detect a decrease in an energy level received by the reflector sensor indicating that an object is located between the reflector and the lens. The method also comprises providing energy to a retroreflector located on the housing proximate to the lens, monitoring a retroreflector sensor to detect a decrease in energy reflected by the retroreflector back into the housing due to an object being located on the retroreflector, and issuing an anti-masking alarm in response to a detection of an object during the monitoring steps.

In one illustrated embodiment, the providing and monitoring steps are performed sequentially in order to reduce the likelihood that an intruder may defeat the anti-masking system. In another illustrated embodiment, the providing and monitoring steps may be performed simultaneously.

In yet another illustrated embodiment of the present disclosure, an anti-masking system is provided for a motion detector including a housing having a lens. The anti-masking system comprises an energy source, and a retroreflector located on the housing proximate to the lens. The retroreflector is configured to receive and reflect energy from the energy source. The system also comprises a retroreflector sensor located within the housing to detect energy from the energy source that is reflected back into the housing by the retroreflector, and a controller configured to selectively supply energy from the energy source to the retroreflector. The controller is also configured to monitor signals from the retroreflector sensor to determine whether an object is located on the retroreflector.

Additional features of the present invention will become apparent to those skilled in the art upon consideration of the following detailed description of illustrative embodiments exemplifying the best mode of carrying out the invention as presently perceived.

BRIEF DESCRIPTION OF THE DRAWINGS

The above-mentioned and other features, and the manner of attaining them, will become more apparent by reference to the following description of illustrated embodiments of the disclosure taken in conjunction with the accompanying drawings, wherein.

DETAILED DESCRIPTION OF THE DRAWINGS

Figure 1:
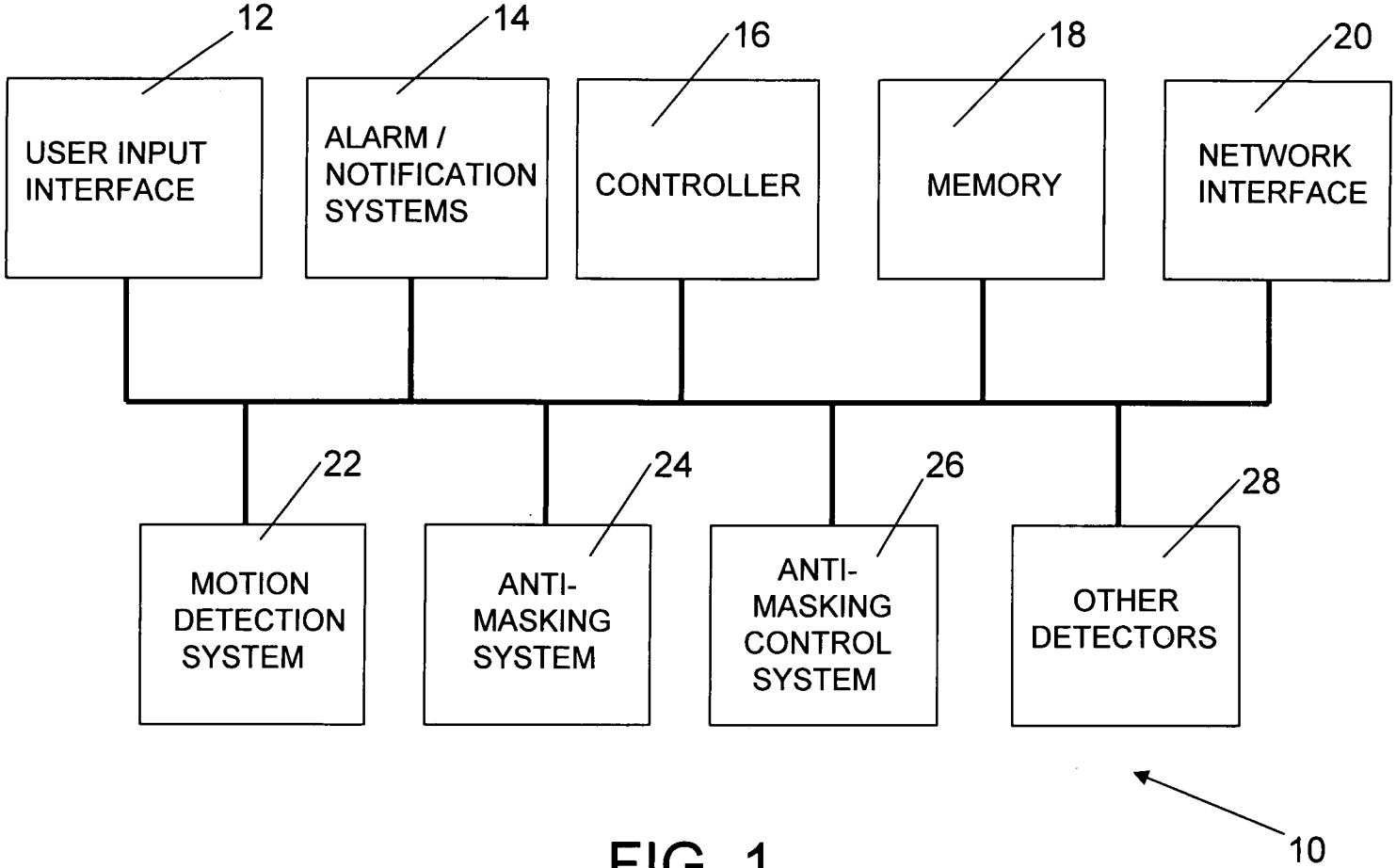
FIG. 1 is a block diagram illustrating components of a security system environment in accordance with an embodiment of the present disclosure.

Before embodiments of the disclosure are explained in detail, it is to be understood that the invention is not limited in its application to the details of the examples set forth in the following description or illustrated in the drawings. The invention is capable of other embodiments and of being practiced or carried out in a variety of applications and in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "connected" and "coupled" are used broadly and encompass both direct and indirect mounting, connecting, and coupling.

Embodiments of the present disclosure are directed to a system and method for controlling an anti-masking system that operates to detect tampering with a motion detection system. The motion detection system may typically be incorporated in a security system.

FIG. 1 is a block diagram illustrating components of a security system environment in accordance with an illustrated embodiment of the disclosure. In the illustrated system, a security system 10 may include a user input interface 12, alarm and notification systems 14, a controller 16, a memory 18, and a network interface 20. The security system 10 may also include a motion detection system 22, an anti-masking system 24, an anti-masking control system 26, and other detectors 28. The components of the motion detection system 22, along with the anti-masking system 24 and the anti-masking control system 26 may operate so as to ensure detection, prevent tampering, and minimize false alarms related to tampering. All of the aforementioned components may be linked by a system bus or other appropriate mechanism or mechanisms. The other detectors 28 may illustratively include smoke detectors, vibration detectors, or other suitable detectors useful for a security system.

With regard to the user input interface 12, a user may enter commands and information using input devices such as a keyboard, a keypad and/or a pointing device, commonly referred to as a mouse, trackball or touch pad. Other input devices may include a microphone, satellite dish, scanner, or the like. These and other input devices are often connected to the controller 16 through the user input interface 12 that is coupled to the system bus, but may be connected by other interface and bus structures, such as a parallel port or a universal serial bus (USB). A monitor or other type of display device and other peripherals may also be connected to the system bus via an interface.

The alarm/notification system 14 may be operable to trigger an alarm upon detecting a security violation. The security violation may be detected by the detectors 22 or 28, which subsequently send a signal to the alarm/notification system 14. The alarm/notification system 14 may activate any appropriate type of visible or audible alarm including both remote and proximal alarms. The alarm/notification system 14 may also be used to provide an anti-masking alarm when tampering is detected as discussed below.

The system memory 18 may include computer storage media in the form of volatile and/or nonvolatile memory such as read only memory (ROM) and random access memory (RAM). A basic input/output system (BIOS), containing the basic routines that help to transfer information between elements within the security system environment 10, such as during start-up, is typically stored in ROM. RAM typically contains data and/or program modules that are immediately accessible to and/or presently being operated on by processing unit 16.

The RAM may include an operating system, program data, and application program. The application programs may be described in the general context of computer-executable instructions, such as program modules, being executed by a computer. Generally, program modules include routines, programs, objects, components, data structures, etc. that perform particular tasks or implement particular abstract data types. Moreover, those skilled in the art will appreciate that the system and method may be practiced with other computer system configurations, including multiprocessor systems, microprocessor-based or programmable consumer electronics, minicomputers, mainframe computers, and the like.

The security system environment 10 may also include other removable/non-removable, volatile/nonvolatile computer storage media. A hard disk drive may be provided that reads from or writes to non-removable, nonvolatile magnetic media, a magnetic disk drive that reads from or writes to a removable, nonvolatile magnetic disk, and an optical disk drive that reads from or writes to a removable, nonvolatile optical disk such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive is typically connected to the system bus through a non-removable memory interface. The magnetic disk drive and optical disk drive are typically connected to the system bus by a removable memory interface.

Although FIG. 1 shows only one network interface module 20, more than one network interface module 20 may be present and connected to a router, switch or hub. The security system 10 in embodiments of the present disclosure may operate in a networked environment using logical connections to communicate with networked components. Logical connections for networking may include a local area network (LAN) or a wide area network (WAN), but may also include other networks. When used in a LAN networking environment, the system may be connected to the LAN through the network interface 20 or adapter.

The detectors 28 may include any type of detectors suitable for implementation in a security system. For example, the detectors may include smoke detectors, vibration detectors or any other types of detectors. The motion detectors 22 and the other detectors 28 may be wirelessly connected or hardwired to the security system 10.

The detector or detectors of the motion detection system 22 may include a passive infrared (PIR) motion detector. The motion detection system 22 could include a dual detector using both PIR and microwave (MW) technologies. An example of such a dual detector is disclosed in U.S. Pat. No. 7,034,675, which is incorporated herein by reference. The detection system using the PIR and or MW detectors may identify when an intruder is present and activate or wake up the anti-masking system 24 through the use of the anti-masking control system 26 as described in U.S. Publication No. 2008/0084292 which is incorporated herein by reference.

Although FIG. 1 illustrates one example of a security system 10, the motion detection system 22, anti-masking system 24, and anti-masking control system 26 may be implemented in any appropriate security system environment. The illustrated security system 10 is merely an example of a suitable environment for the system and is not intended to suggest any limitation as to the scope of use or functionality of the system. Neither should the security system 10 be interpreted as having any dependency or requirement relating to any one or combination of components illustrated.

Figure 2:
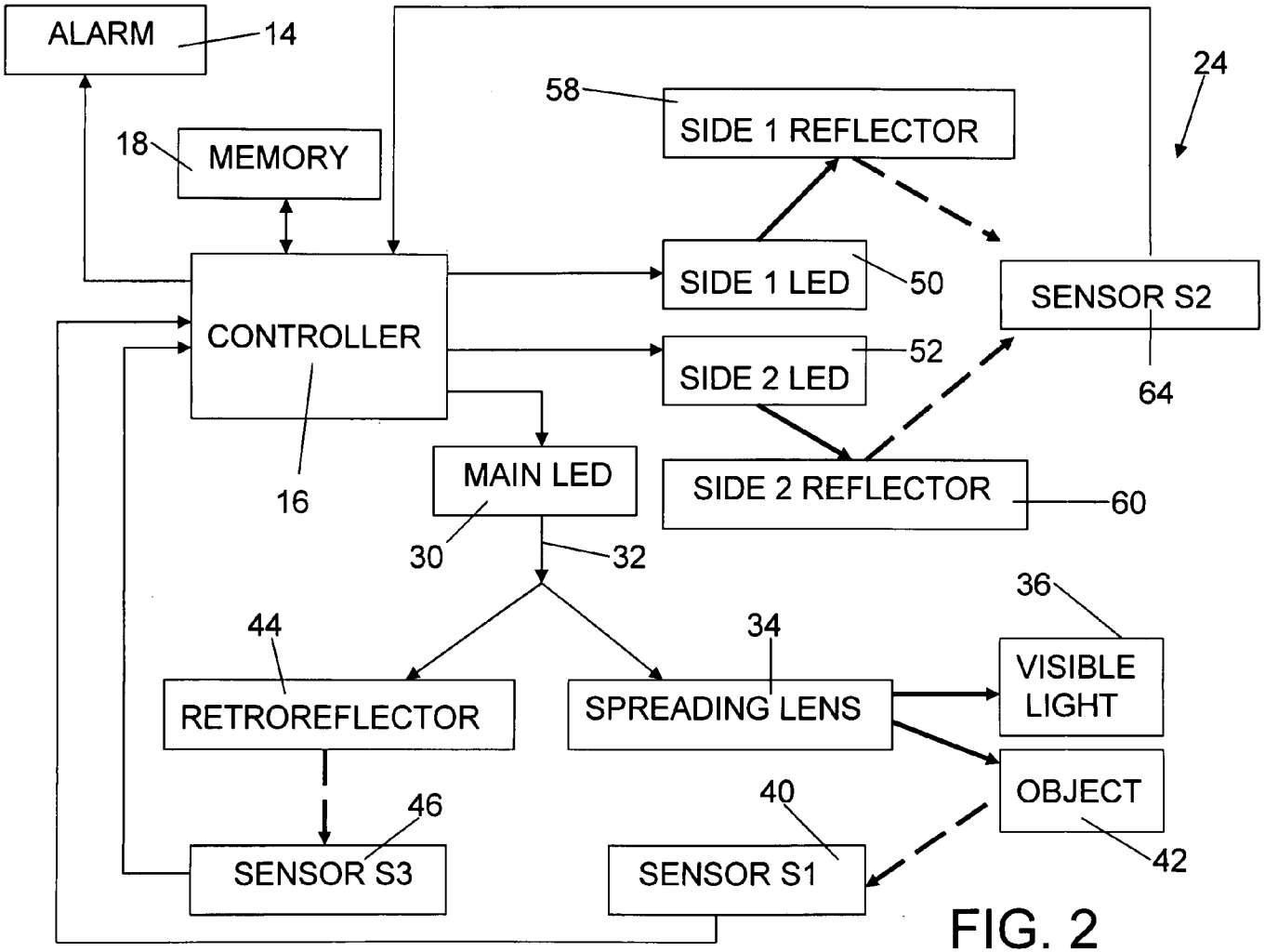
FIGS. 2-5 are block diagrams illustrating components of an anti-masking system in accordance with an illustrated embodiment of the present disclosure.
Figure 3:
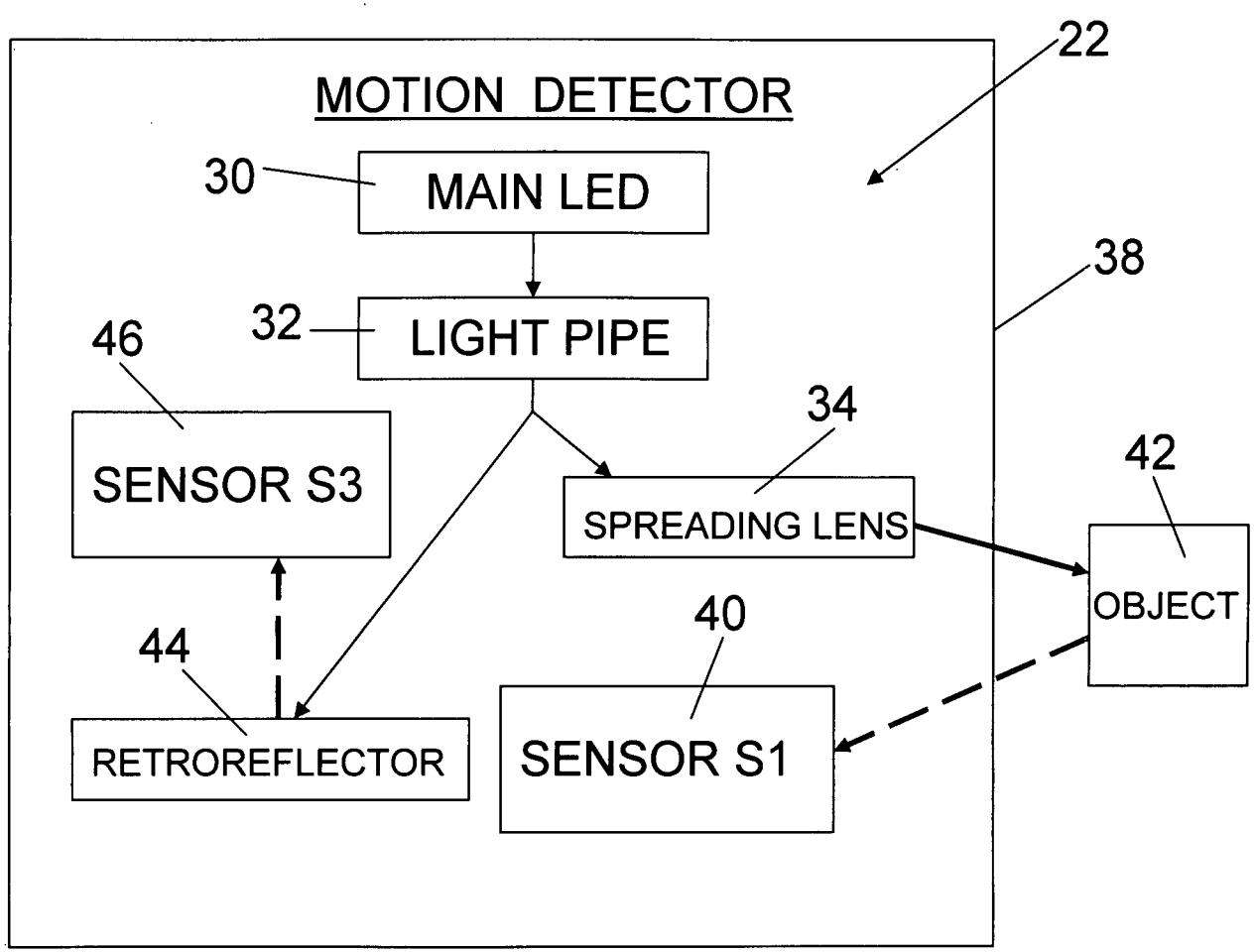

FIG. 2 illustrates the anti-masking system 24 of a motion detector 22 in more detail. The anti-masking system 24 may include an active IR sensors capable of detecting objects within a short distance, for example, such as less than three feet or anywhere from less than one inch to five feet as discussed below. The anti-masking system 24 includes a main energy source 30, such as, for example an infrared energy source. Illustratively, the energy source in an IR LED 30 in communication with a main light pipe 32 which receives both IR energy and visible light from LED 30. A first portion of the IR energy and visible light is passed from light pipe 32 through a spreading lens 34 to an area outside a housing 38 of motion detector 22 as best shown in FIG. 3. Visible light is emitted from spreading lens 34 to an area outside a housing 38 of motion detector 22 as illustrated at block 36 in FIG. 2. The visible light is illustratively used to indicate a condition of the motion detector 22 to a user, such as that the motion detector 22 is in an alarm condition. Therefore, in the illustrated embodiment, the visible light is not used for anti-masking purposes.

IR energy is also emitted from spreading lens 34 to the area located outside of the housing 38 of the motion detector 22 as best shown in FIG. 3. The IR energy emitted from spreading lens 34 does not result in a detected signal from a sensor S1 illustrated at block 40 unless a blocking object 42 enters the area in front of housing 38 and reflects some of the IR energy from spreading lens 34 back to sensor S1. An output of sensor S1 (illustrated at block 40) is coupled to controller 16 as shown in FIG. 3. Controller 16 monitors the signal from sensor S1 to detect a blocking object 42 used to mask the detector 22 as discussed below.

Another portion of IR energy from main LED 30 passes through light pipe 32 to a retroreflector 44 located on the housing 38 on or near the main lens 62. Illustratively about 0.5% of the total IR energy from LED 30 is directed to the retroreflector 44. In one illustrated embodiment, the retroreflector 44 is a device that reflects energy back along a vector that is parallel to but opposite in direction from the angle of incidence. This is unlike a mirror (or other reflective surface) which does that only if the mirror (or other reflective surface) is exactly perpendicular to the wave front.

The retroreflector 44 directs most of the IR energy back to a sensor S3 (illustrated at block 46) which is located inside the housing 38 as best shown in FIG. 3. However, if a liquid is sprayed or otherwise applied to the retroreflector 44, or if tape is applied to the retroreflector 44, the reflection of retroreflector 44 stops (or is reduced) and the reduction in IR energy reaching sensor S3 is detected by controller 16. Controller 16 may then generate an alarm or other notification 14 indicating detection of such tampering.

Figure 4:
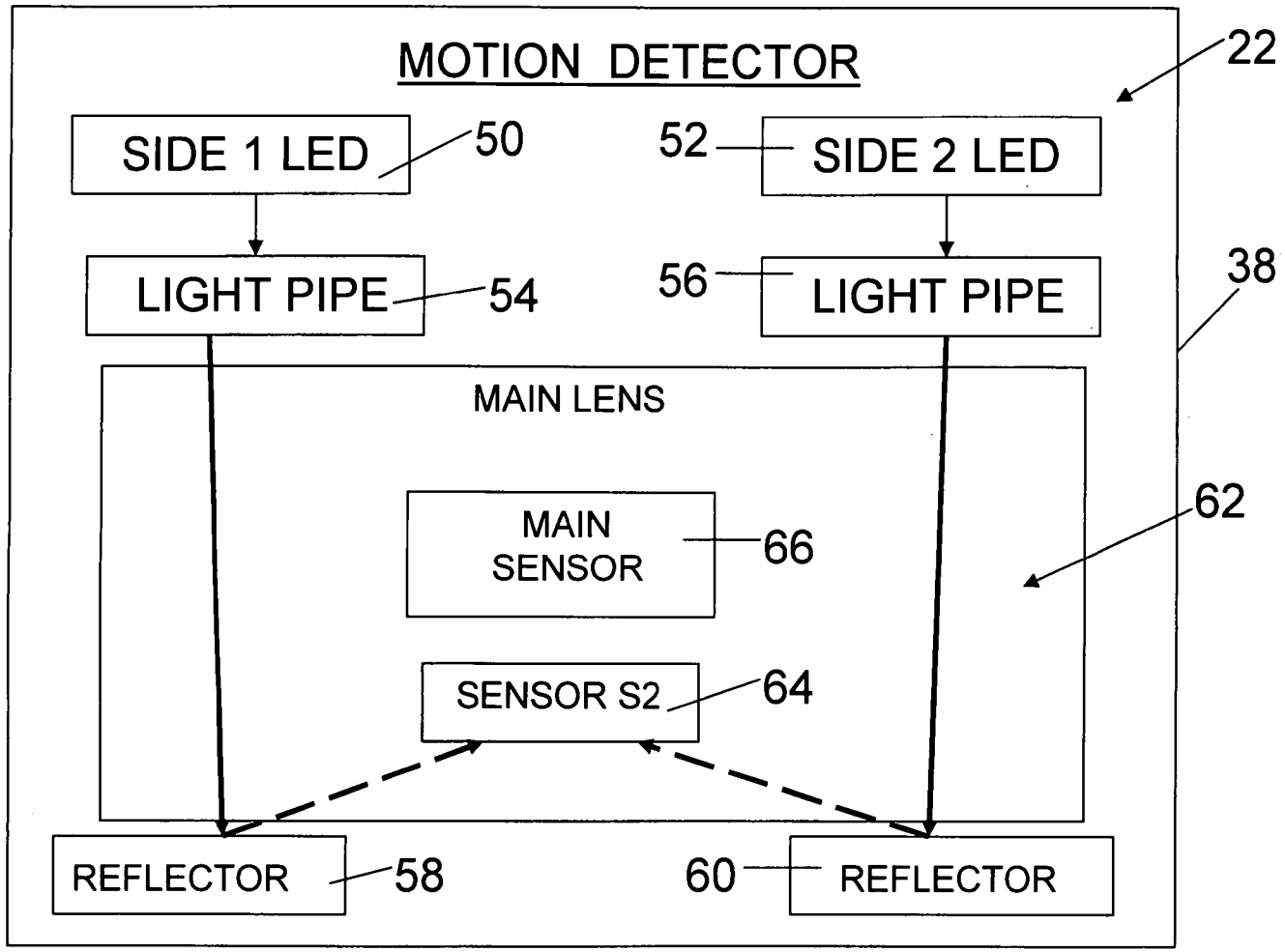

The anti-masking system 24 also includes two side energy sources 50 and 52, such as, for example an infrared energy sources. Illustratively, energy sources 50 and 52 are IR LEDS 50 and 52 located inside the housing 38 of motion detector 22 as illustrated in FIGS. 2 and 4. The IR output from LEDS 50 and 52 is directed via light pipes 54 and 56, respectively, to reflectors 58 and 60, respectively, located outside the housing 38 of detector 22. In an illustrated embodiment as best shown in FIG. 4, the reflectors 58 and 60 are located near bottom corners of the housing 38 of detector 22 adjacent the main lens 62. Therefore, the IR energy from first side LED 50 passes through light pipe 54 and is reflected off reflector 58 back through main lens 62 to a sensor S2 illustrated at block 64. In an illustrated embodiment, sensor S2 is separate from a main sensor 66 of the motion detector 22. Main sensor 66 may be a PIR or MW sensor. In other embodiments, a single sensor may be used for both the motion detection and anti-masking functions of detector 22.

IR energy from second side LED 52 is directed through light pipe 56 to the second reflector 60. The IR energy is reflected from second reflector 60 through the lower main lens 62 to sensor S2 at block 64. If an object such as tape, for example, is placed on the main lens or if paint or other material is sprayed or otherwise applied to the main lens 62, the signal received by sensor S2 decreases causing controller 16 to issue an alarm 14 indicating such tampering.

In certain anti-masking systems, intruders have found ways to counteract the anti-masking system. For instance, if darkened packing tape and cardboard background is used in a conventional IR anti-masking system, the tape may cause a reduction in the IR signal but the cardboard reflects the energy in the area of the front of the detector to increase the signal so the unit does not alarm. The present system and method reduces the likelihood of an intruder defeating the anti-masking system by driving the LEDs 30, 50, 52 at different times as discussed below.

Figure 5:
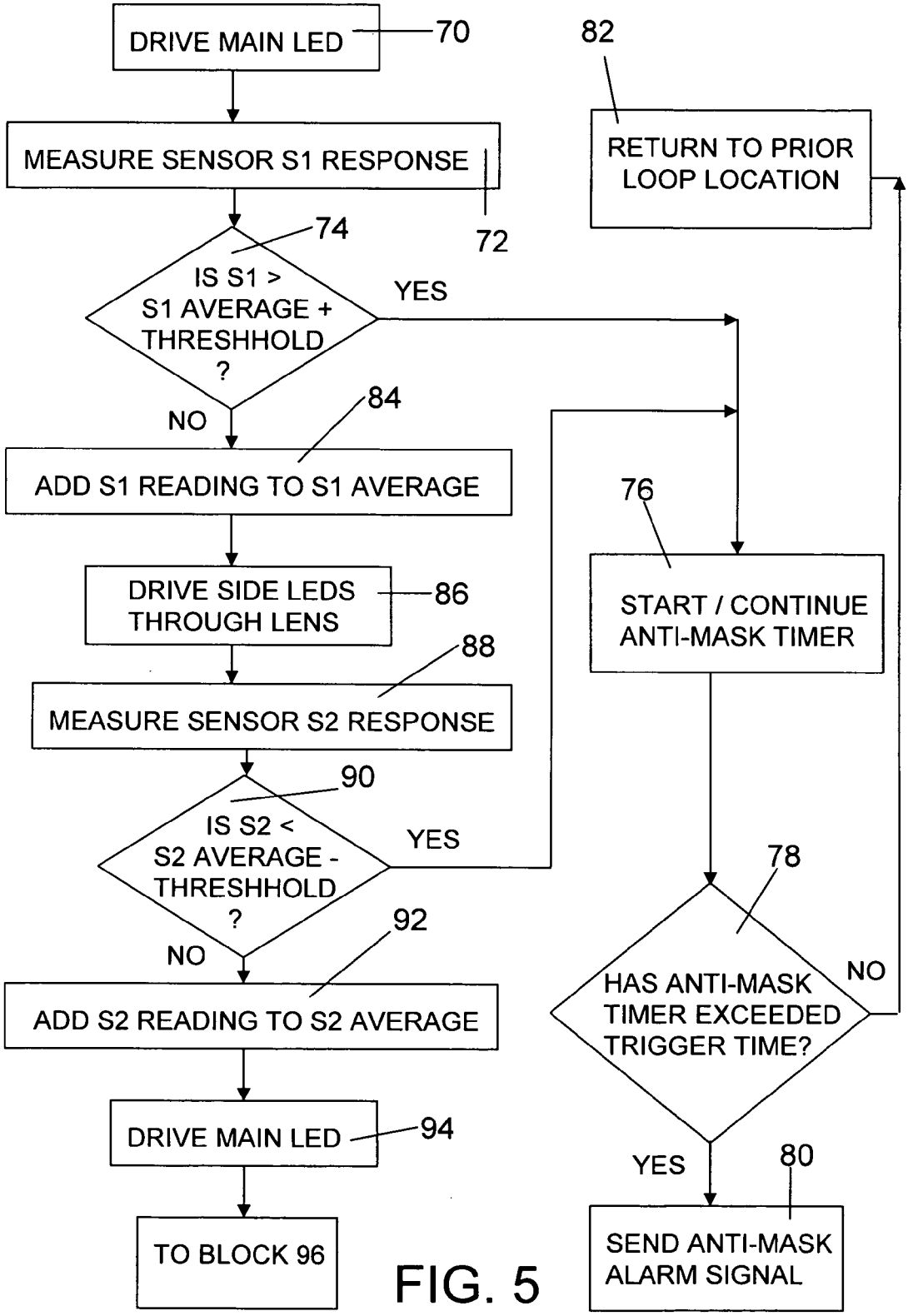
Figure 6:
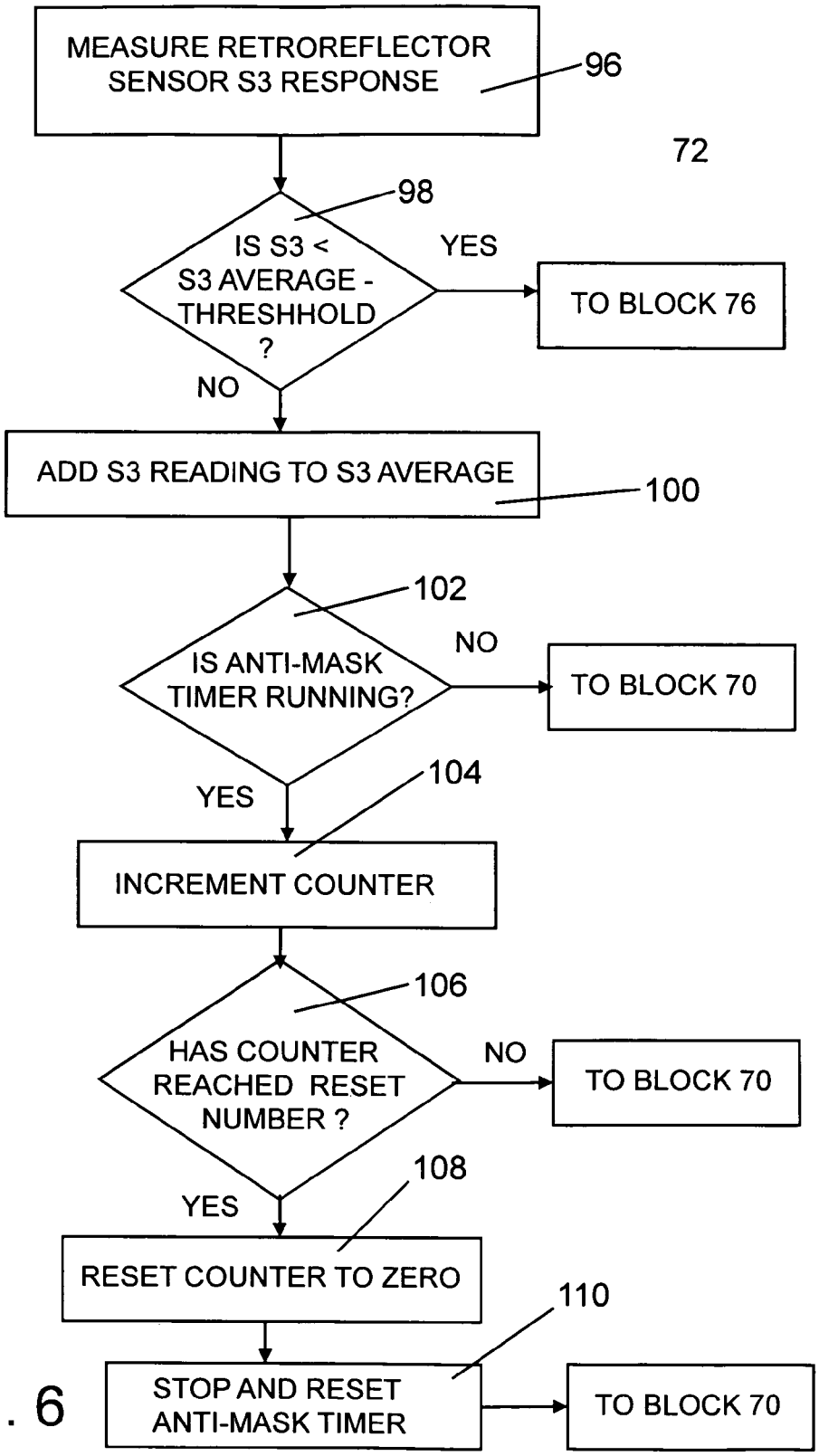
FIG. 6 is a flow chart illustrating a method for controlling the anti-masking system in accordance with an embodiment of the present disclosure.

FIGS. 5 and 6 are flowcharts illustrating a method of operation of the anti-masking system 24 described above. First, controller 16 drives the main IR LED 30 as illustrated at block 70. The controller 16 then measure an output response from sensor S1 as illustrated at block 72. Sensor S1 detects whether or not an object 42 is located near spreading lens 34. Controller 16 determines whether the output from sensor S1 is greater than the average output from sensor S1 plus a predetermined threshold value as illustrated at block 74. In an illustrated embodiment, the predetermined threshold value may be about 100 mv.

If the detected output from sensor S1 at block 72 is greater than the average output of sensor S1 plus the threshold value at block 74, controller 16 either starts or continues an anti-mask timer as illustrated at block 76. Controller 16 then determines whether the anti-mask timer has exceeded a predetermined trigger time as illustrated at block 78. The trigger timer may be about 5 seconds in an illustrated embodiment. If so, controller 16 sends an anti-mask alarm signal to alarm 14 at block 80 to alert a user or system operator that the motion detector 22 has been masked or blocked. If the anti-mask timer has not exceeded the preset trigger time at block 78, the controller 16 returns to the next point in the main loop as illustrated at block 82. For example, the controller 16 would next drive the side LEDs 50 and 52 at block 86 as discussed below.

If the controller 16 determines that the response of sensor S1 is not greater than the average output of sensor S1 plus the threshold value at block 74 (indicating that no object 42 has been detected by sensor S1), the controller 16 adds the current sensor S1 reading to the average output of sensor S1 at block 84. Controller 16 then drives side LEDs 50 and 52 through the lower main lens 62 as illustrated at block 86. As discussed above, side LEDs 50 and 52 send IR energy through light pipes 54 and 56 to reflectors 58 and 60, respectively. Reflected IR energy from reflectors 58 and 60 passes through lower main lens 62 to sensor S2. (See block 64 in FIGS. 2 and 4.)

Controller 16 then measures the sensor S2 response as illustrated at block 88. If the output from sensor S2 is less than an average output of sensor S2 minus a predetermined threshold at block 90, controller 16 advances to block 76 to start or continue the anti-mask timer as discussed above. A reduction in sensor S2 response indicates masking of the main lens 62. If the output from sensor S2 is not less than the average value of S2 minus a threshold value (indicating that no masking is detected), the controller 16 adds the current sensor S2 reading to the sensor S2 average output at block 92. Illustratively the threshold value for sensor S2 may be about 100 mv.

Next, controller 16 drives the main LED 30 again as illustrated at block 94. Controller 16 then advances to block 96 in FIG. 5. The controller 16 then measures a response of retroreflector S3 (see block 46 in FIGS. 2 and 3) as illustrated at block 96 to defect IR energy reflected back from retroreflector 44. If the output from sensor S3 is less than the average output of sensor S3 minus a threshold value at block 98, controller 16 advances back to block 76 in FIG. 4 to start or continue the anti-mask timer as discussed above. Since covering of the retroreflector with paint or other object reduces reflection, the response of sensor S3 drops when such tampering occurs. Illustratively, the threshold value for the retroreflector sensor S3 may be about 75 mv. If the anti-mask timer has not exceeded the trigger time at block 78, controller advances back to block 70 to start the loop again.

If the current output from sensor S3 is not less than the average value of sensor S3 output minus the threshold value at block 98, controller 16 adds the current sensor S3 output to the sensor S3 average response at block 100. The controller 16 then determines whether the anti-masked timer is running at block 102. If the anti-masking timer is not running at block 102 (indicating no current tampering has been detected), controller 16 returns to block 70 and proceeds through the control loop again.

If the anti-mask timer is running at block 102, the controller 16 increments a counter at block 104. The controller 16 then determines whether or not the counter has reached a predetermined reset number value as illustrated at block 106. If the counter has not reached the reset number at block 106, the controller advances back to block 70 and starts the control loop again. If the counter has reached its reset number at block 106, the counter is reset to zero at block 108. Controller 16 then stops and resets the anti-mask alarm timer to zero as illustrated at block 110 and proceeds back to block 70 to begin the loop again. In other words, if controller 16 proceeds through the control loop shown in FIGS. 5 and 6 a number of times equal to the reset number without detecting a masking event with sensors S1, S2 or S3 before the anti-mask alarm trigger time is exceeded, then timer is stopped and reset. In an illustrated embodiment, the reset number may be 4.

By triggering the main LED 30 and side LEDs 50 and 52 at different times and measuring the responses of sensors S1, S2, and S3 at different times, the anti-masking system 24 reduces the likelihood that an intruder can defeat the anti-masking system. Sensors S1, S2 and S3 are any suitable sensors such as, for example, pyrodetectors, phototransistors and/or photodiodes. The use of the counter to reset the anti-mask alarm timer reduces the likelihood of false alarms. Therefore, the anti-mask timer will likely be reset before an alarm is generated if the anti-masking system 24 is triggered to start the anti-mask timer by a false alarm such as when a bird, bug, radio frequency interference, IR light sources, florescent lights, PDAs, or the like are detected adjacent the housing 38 by sensors S1, S2, S3.

While the present system and methods have been illustrated and described in detail in the drawings and foregoing description, the description is to be considered as illustrative and not restrictive in character. Variations and modifications exist within the scope and spirit of the present invention as described and defined herein and in the following claims.

The invention claimed is:

1. An anti-masking system for a motion detector including a housing having a lens, the anti-masking system comprising:

at least one energy source;

a spreading lens configured to receive energy from an energy source and to emit the energy outside the housing of the motion detector;

a spreading lens sensor located inside the housing to detect energy emitted from the spreading lens which is reflected back into the housing through the lens from an object located outside the housing;

at least one reflector located outside the housing adjacent the lens, the at least one reflector being configured to reflect energy received from an energy source back into the housing through the lens;

a reflector sensor located within the housing, the reflector sensor detecting reflected energy from the at least one reflector to determine whether an object is located between the at least one reflector and the lens;

a retroreflector located on the housing proximate to the lens, the retroreflector being configured to receive and reflect energy from an energy source;

a retroreflector sensor located within the housing to detect energy reflected back into the housing by the retroreflector to determine whether an object is located on the retroreflector; and a controller configured to selectively supply energy from the at least one energy source to the spreading lens, the at least one reflector, and the retroreflector, the controller also being configured to monitor signals from the spreading lens sensor, the reflector sensor, and the retroreflector sensor to determine whether the lens of the motion detector has been masked by an object.

2. The anti-masking system of claim 1, wherein the controller is configured to issue an alarm in response to detecting at least one of:

an increase in energy detected by the spreading lens sensor caused by a reflection of energy from an object adjacent the spreading lens;

a decrease in energy detected by the reflector sensor caused by an object being located between the reflector and the lens; and a decrease in energy detected by the retroreflector sensor caused by an object located on the retroreflector.

3. The anti-masking system of claim 1, further comprising a visible light emitter coupled to the housing and configured to receive visible light from the at least one energy source to indicate a condition of the motion detector.

4. The anti-masking system of claim 1, wherein the system includes first and second reflectors located outside the housing on opposite sides of the lens, both the first and second reflectors being configured to reflect energy from an energy source back through the lens to the reflector sensor located within the housing.

5. The anti-masking system of claim 4, wherein a first energy source is coupled to the spreading lens and the retroreflector, a second energy source is configured to supply energy to the first reflector, and a third energy source is configured to supply energy to the second reflector, the controller being configured to control the timing of energy emitted from the first, second and third energy sources.

6. The anti-masking system of claim 5, further comprising a first light pipe coupled between the first energy source and the spreading lens and retroreflector, a second light pipe coupled to the second energy source, the second light pipe being configured to direct energy to the first reflector located outside the housing, and a third light pipe coupled to the third energy source, the third light pipe being configured to direct energy to the second reflector located outside the housing.

7. The anti-masking system of claim 1, wherein the spreading lens sensor, the reflector sensor, and the retroreflector sensor are separate sensors.

8. The anti-masking system of claim 1, wherein the spreading lens sensor, the reflector sensor, and the retroreflector sensor are the same sensor.

9. The anti-masking system of claim 1, wherein the at least one energy source includes an infrared LED.

10. The anti-masking system of claim of claim 1, wherein the controller is configured to control a timing circuit sequentially:

to supply energy from the at least one energy source to the spreading lens;

to detect a response from the spreading lens sensor to determine whether an object is reflecting energy back into the housing through the lens;

to supply energy from the at least one energy source to the at least one reflector;

to detect a response of the reflector sensor to determine whether an object is located between the at least one reflector and the lens;

to supply energy from the at least one energy source to the retroreflector;

to detect a response from the retroreflector sensor to determine whether an object is located on the retroreflector;

to start an anti-mask alarm timer in response to any detecting such objects; and to issue an anti-mask alarm when the anti-mask timer exceeds a predetermined trigger time.

11. The anti-masking system of claim of claim 1, wherein the object is at least one of paint and tape.

12. A method for controlling operation of an anti-masking system of a motion detector having a lens and a housing, the method comprising:

providing energy with a controller from at least one energy source to a spreading lens to emit energy to an area outside the housing;

monitoring with the controller a spreading lens sensor to detect an object reflecting energy emitted from the spreading lens back into the housing through the lens;

providing energy with the controller from at the least one energy source to a reflector located outside the housing adjacent the lens, the reflector reflecting the energy back into the housing through the lens;

monitoring with the controller a reflector sensor to detect a decrease in an energy level received by the reflector sensor indicating that an object is located between the reflector and the lens;

providing energy with the controller from at the least one energy source to a retroreflector located on the housing proximate to the lens;

monitoring with the controller a retroreflector sensor to detect a decrease in energy reflected by the retroreflector back into the housing due to an object being located on the retroreflector; and issuing an anti-masking alarm with the controller in response to a detection of an object during the monitoring steps.

13. The method of claim 12, wherein the providing and monitoring steps are performed sequentially in order to reduce the likelihood that an intruder may defeat the anti-masking system.

14. The method of claim 12, wherein the monitoring steps detect a difference between a detected response of the spreading lens sensor, the reflector sensor, and the retroreflector sensor and an average response of the spreading lens sensor, the reflector sensor, and the retroreflector sensor, respectively.

15. The method of claim 14, wherein the monitoring steps determine that an object is present adjacent the lens when a detected response of at least one of the spreading lens sensor, the reflector sensor, and the retroreflector sensor differs from an average response of the spreading lens sensor, the reflector sensor, and the retroreflector sensor, respectively, by an amount greater than a predetermined threshold value.

16. The method of claim 15, further comprising the step of averaging with the controller the detected response of the spreading lens sensor, the reflector sensor, and the retroreflector sensor with the average response of the spreading lens sensor, the reflector sensor, and the retroreflector sensor, respectively, if an object is not detected adjacent the lens during the monitoring steps.

17. The method of claim 12, wherein the issuing step comprises:

starting an anti-mask timer with the controller upon detection of an object in at least one of the monitoring steps;

performing the providing and monitoring steps a plurality of times to look for continued detection of the object;

stopping and resetting the anti-mask timer with the controller if a predetermined number of providing and monitoring steps occur without further detection of the object and before the anti-mask timer exceeds a predetermined trigger time; and issuing the anti-mask alarm with the controller if the anti-mask timer exceeds the predetermined trigger time.

18. An anti-masking system for a motion detector including a housing having a lens, the anti-masking system comprising:

an energy source;

a retroreflector located on the housing proximate to the lens, the retroreflector being configured to receive and reflect energy from the energy source;

a retroreflector sensor located within the housing to detect energy from the energy source that is reflected back into the housing by the retroreflector; and a controller configured to selectively supply energy from the energy source to the retroreflector, the controller also being configured to monitor signals from the retroreflector sensor to determine whether an object is located on the retroreflector, and wherein the controller is configured to issue an alarm in response to detecting a reduction in energy detected by the retroreflector sensor caused by reduced reflection of the energy by the retroreflector when the object located on the retroreflector.

19. The anti-masking system of claim 18, wherein the energy source comprises an infrared LED and a light pipe coupled between the infrared LED and the retroreflector.

* * * * *